US011072062B2

(12) United States Patent
Fuenfer

(10) Patent No.: US 11,072,062 B2
(45) Date of Patent: Jul. 27, 2021

(54) HANDHELD POWER TOOL

(71) Applicant: Hilti Aktiengesellschaft, Schaan (LI)

(72) Inventor: Josef Fuenfer, Koenigsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 190 days.

(21) Appl. No.: 16/092,823

(22) PCT Filed: Apr. 11, 2017

(86) PCT No.: PCT/EP2017/058624
§ 371 (c)(1),
(2) Date: Oct. 11, 2018

(87) PCT Pub. No.: WO2017/178461
PCT Pub. Date: Oct. 19, 2017

(65) Prior Publication Data

US 2019/0118363 A1 Apr. 25, 2019

(30) Foreign Application Priority Data

Apr. 13, 2016 (EP) ..... 16165048

(51) Int. Cl.
*B25D 17/06* (2006.01)
*B25D 17/24* (2006.01)

(52) U.S. Cl.
CPC ..... *B25D 17/06* (2013.01); *B25D 17/24* (2013.01); *B25D 2211/068* (2013.01);
(Continued)

(58) Field of Classification Search
CPC ..... B25D 11/005; B25D 11/04; B25D 2250/365; B25D 2250/085;
(Continued)

(56) References Cited

U.S. PATENT DOCUMENTS 1,657,387 A 1/1928 Goldschmidt et al.
3,460,637 A 8/1969 Schulin et al.
(Continued)

FOREIGN PATENT DOCUMENTS

CN 1358612 A 7/2002
CN 1745976 A 3/2006
(Continued)

OTHER PUBLICATIONS

International Search Report of PCT/EP2017/058624, dated Jul. 6, 2017.

*Primary Examiner* — Valentin Neacsu
(74) *Attorney, Agent, or Firm* — Davidson, Davidson & Kappel, LLC

(57) ABSTRACT

A handheld power tool (1) is provided, including a tool holder (2) for receiving and locking a tool (3) on a working axis (4), and including a power tool housing (6). A striking mechanism (8) includes a striker (10) for applying impacts in the impact direction (9) and an anvil (11) for absorbing the impacts and for transmitting the impacts in the impact direction (9) onto the tool (3) accommodated in the tool holder (2). A collar (18) is fastened to the power tool housing (6) and to the anvil (11). When the anvil (11) abuts a rebound impact damper (13) in the impact direction (9), the elastic collar (18) applies a force acting in the impact direction (9) onto the anvil (11).

9 Claims, 2 Drawing Sheets

(52) U.S. Cl.
CPC ..... *B25D 2217/0015* (2013.01); *B25D 2217/0065* (2013.01); *B25D 2217/0073* (2013.01); *B25D 2222/57* (2013.01); *B25D 2250/051* (2013.01); *B25D 2250/145* (2013.01); *B25D 2250/265* (2013.01); *B25D 2250/365* (2013.01); *B25D 2250/371* (2013.01)

(58) Field of Classification Search
CPC ..... B25D 2250/381; B25D 2250/371; B25D 2250/345; B25D 2250/191; B25D 2250/051; B25D 2250/145; B25D 2217/0015; B25D 2217/0011; B25D 2217/0019; B25D 2217/0065; B25D 2217/0073; B25D 2217/0092; B25D 2222/57; B25B 21/023; B25B 21/02
USPC ..... 173/162.1, 211, 210, 128, 129, 133
See application file for complete search history.

(56) References Cited

U.S. PATENT DOCUMENTS

| | | | | |
|---|---|---|---|---|
| 9,079,286 | B1 * | 7/2015 | DeCamillis | B24B 23/02 |
| 10,286,537 | B2 * | 5/2019 | Koch | B25D 17/06 |
| 2002/0070036 | A1 | 6/2002 | Frenzel et al. | |
| 2006/0054012 | A1 | 3/2006 | Baumann et al. | |
| 2008/0210451 | A1 * | 9/2008 | Aoki | B25D 17/06 173/211 |
| 2008/0283260 | A1 | 11/2008 | Kramer et al. | |
| 2010/0307783 | A1 * | 12/2010 | Baumann | B25D 17/24 173/162.2 |
| 2011/0303431 | A1 * | 12/2011 | Hartmann | B25D 11/005 173/114 |
| 2012/0125650 | A1 * | 5/2012 | Koch | B25D 17/24 173/211 |
| 2016/0279778 | A1 * | 9/2016 | Koch | B25D 17/06 |

FOREIGN PATENT DOCUMENTS

| | | | | |
|---|---|---|---|---|
| CN | 101298136 | A | 11/2008 | |
| EP | 1048415 | A2 * | 11/2000 | B25D 11/005 |
| EP | 1048415 | A2 | 11/2000 | |
| FR | 1562802 | | 4/1969 | |
| GB | 209 354 | A | 1/1924 | |

* cited by examiner

HANDHELD POWER TOOL

The present invention relates to a chiseling handheld power tool.

BACKGROUND

A hammer drill is known from EP 1048415 A2. The hammer drill includes a striking mechanism having a striker, which is periodically moved back and forth on a working axis via an electropneumatic drive. The striker strikes a tool with each revolution in an impact direction. A flexible, impermeable fabric extends from the striker to a tube surrounding the striker. The fabric does not influence the movement of the striker and prevents dust from entering the striking mechanism.

SUMMARY OF THE INVENTION

The present invention provides a handheld power tool that includes a tool holder for receiving and locking a tool on a working axis, and includes a power tool housing. A striking mechanism includes a striker for applying impacts in an impact direction and an anvil for absorbing the impacts and for transmitting the impacts in the impact direction onto the tool accommodated in the tool holder. A collar is fastened to the power tool housing and to the anvil. If the anvil abuts a rebound impact damper in the impact direction, the elastic collar applies a force acting in the impact direction onto the anvil.

An anvil improves the design of the striking mechanism in relation to chisels of different weights. In contrast to the striker, the anvil is not moved continuously but is only briefly moved for this purpose, however at a very high acceleration. The collar fastened to the anvil has an improved resistance when the diaphragm applies a force acting against the impact effect.

For example, the collar includes an inner ring, which is fastened to the anvil, an outer ring, which is fastened to the power tool housing, and an elastic diaphragm connecting the inner ring to the outer ring. The diaphragm is preferably elastically pretensioned when the anvil abuts the rebound impact damper. The force is applied by the diaphragm and not by a separate component. The diaphragm is preferably made from an elastomer.

The anvil may have an end pointing in the impact direction for transmitting an impact onto a tool to which the inner ring is fastened. The anvil includes a stop ring, which is situated in the impact direction upstream from the end pointing in the impact direction. The stop ring abuts a rebound impact damper in the working position counter to the impact direction. An idle stroke damper is situated in the impact direction downstream from the stop ring. The inner ring is preferably situated in the impact direction downstream from the idle stroke damper. The anvil is movably supported in the power tool housing opposite the striker along the working axis.

BRIEF DESCRIPTION OF THE DRAWINGS

The following description explains the present invention based on exemplary specific embodiments and figures. In the figures.

Unless otherwise indicated, identical or functionally equivalent elements are identified by identical reference numerals in the figures.

DETAILED DESCRIPTION

Figure 1:
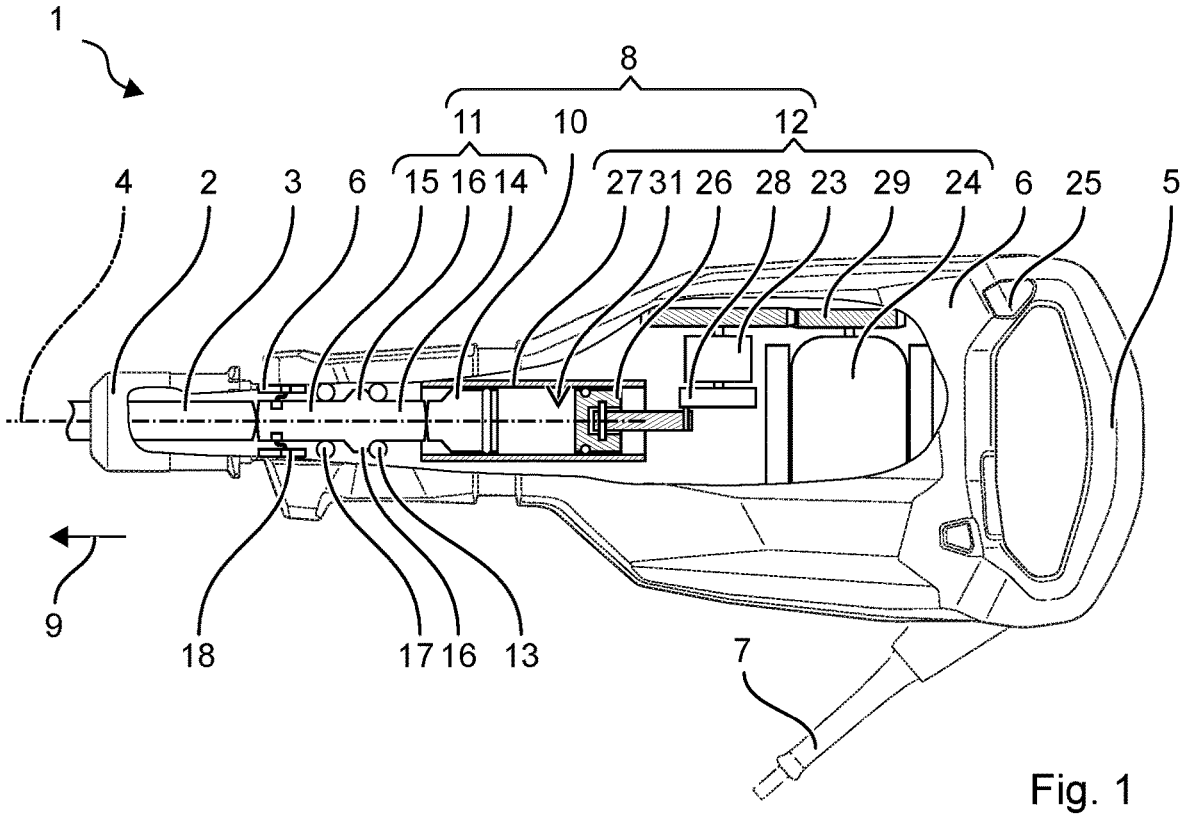
FIG. 1 shows an electric hammer.

FIG. 1 schematically shows an electric hammer 1 as an example of a hand-guided, chiseling power tool. Electric hammer 1 includes a tool holder 2, into which a chisel or another tool 3 may be inserted and locked along a working axis 4. Electric hammer 1 includes a handle 5, which is typically fastened on an end of a power tool housing 6 of electric hammer 1 facing away from tool holder 2. An additional handle may be fastened, for example near tool holder 2. The user may guide and hold electric hammer 1 by handles 5 during chiseling. A power supply may take place via a battery or a power cord 7.

Electric hammer 1 includes a striking mechanism 8, which may periodically strike chisel 3 in impact direction 9. Striking mechanism 8 includes a striker 10 and an anvil 11. Striker 10 is movably situated on working axis 4. Striker 10 is excited by a drive 12 to move periodically on working axis 4. Anvil 11 is also movably situated on working axis 4 independently of striker 10. Striker 10 strikes anvil 11 during its periodic movement in impact direction 9. The shock wave of the impact passes through anvil 11 and is passed on to tool 3 abutting anvil 11.

Figure 2:
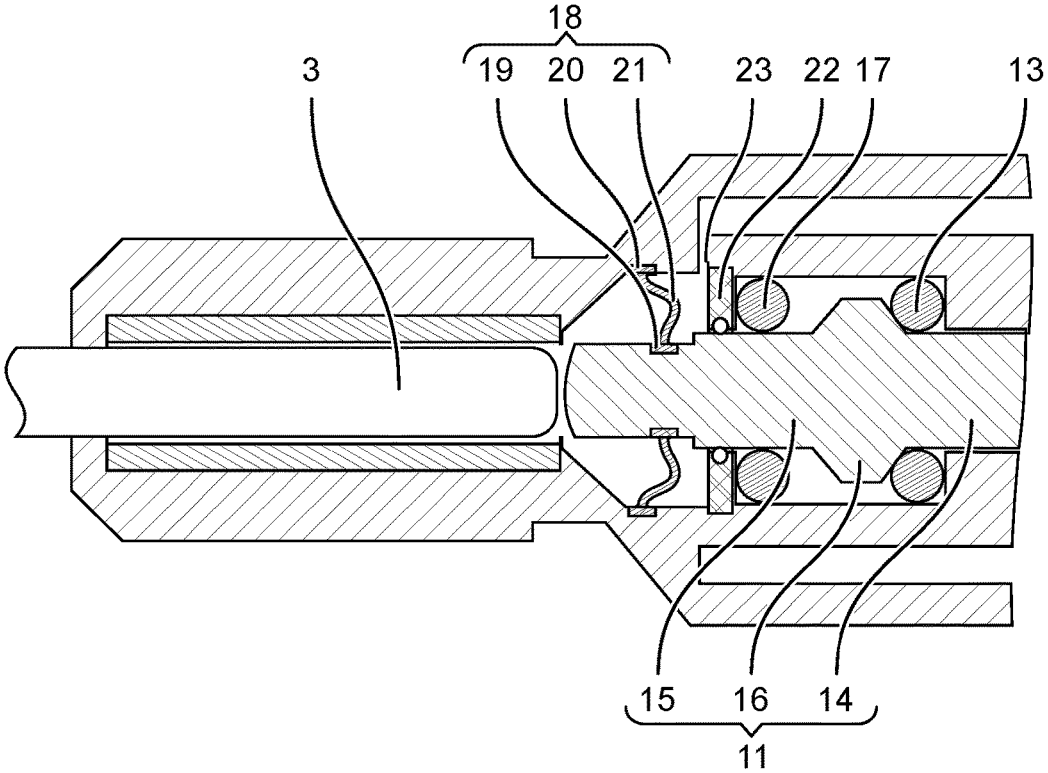
FIG. 2 shows a tool-proximate section of the electric hammer.

In its working position (FIG. 2), anvil 11 abuts a rebound impact damper 13 in its working position counter to impact direction 9. Anvil 11 is held in the working position indirectly by the user. The user presses electric hammer 1 and chisel 3 against a substrate to be chiseled in impact direction 9. Chisel 3 is displaced into electric hammer 1 against impact direction 9. Chisel 3 displaces anvil 11 against impact direction 9 until anvil 11 comes to rest against rebound impact damper 13. The efficiency of striking mechanism 8 is optimized toward the working position of anvil 11. Striking mechanism 8 is preferably automatically switched off when anvil 11 comes to a stop outside the working position or striker 10 strikes anvil 11 outside the working position.

Anvil 11 is a monolithic steel body. Anvil 11 has an impact-absorbing end 14 for absorbing the impact of striker 10 and an impact-delivering end 15 for transmitting the impact to chisel 3. The impact-absorbing end may have a cylindrical design. Impact-delivering end 15 is essentially cylindrical. A diameter of both ends 14, 15 may have approximately the same size. Anvil 11 includes a stop ring 16 between the two ends 14, 15. Stop ring 16 has an enlarged diameter with respect to the two ends 14, 15. Anvil 11, together with stop ring 16, may abut rebound impact damper 13 against impact direction 9 and abut an idle stroke damper 17 in impact direction 9. Stop ring 16 and the two dampers 13, 17 define the working position and the maximum travel distance of anvil 11.

While striker 10 is moved continuously, anvil 11 and tool 3 are usually stationary. However, anvil 11 is briefly very rapidly accelerated by the impact of striker 10. The acceleration is greater than 1000 times the gravitational acceleration. The high acceleration upon each impact and the typical impact frequency in the range from 10 Hz to 100 Hz greatly stress the material of anvil 11. Directly following an impact, anvil 11 and tool 3 are typically displaced by less than two centimeters in impact direction 9. The maximum travel distance is greater than the typical movement during an impact. The deflection of anvil 11 is much less than that of the travel distance completed by striker 10 within striking mechanism 8 between two impacts.

A sealing collar 18 is fastened on impact-delivering end 15 of anvil 11 and on power tool housing 6. Collar 18 includes an inner ring 19, which is fastened along working axis 4 on end 15, and an outer ring 20, which is fastened along working axis 4 on power tool housing 6. The movement of anvil 11 along working axis 4 results in a displacement of inner ring 19 with respect to outer ring 20. Inner ring 19 or outer ring 20 may be rotatably supported around working axis 4 on anvil 11 or power tool housing 6.

The two rings 19, 20 are connected by a diaphragm 21. Diaphragm 21 has a planar or domed surface, whose only edges are formed by inner ring 19 and outer ring 20. Diaphragm 21 may have the shape of a hose which closes a cavity, which is preferably open only at rings 19, 20. Diaphragm 21 may also be folded once or multiple times in the manner of a bellows. The diaphragm preferably has exactly one fold or exactly two folds. Diaphragm 21 is deformed during the movement of anvil 11.

Collar 18 seals striking mechanism 8 which is dust-proof in impact direction 9. Inner ring 19 is inserted, for example, into an annular groove of anvil 11. Inner ring 19 moves together with anvil 11 along working axis 4.

Collar 18 is situated in impact direction 9 downstream from idle stroke damper 17. Dampers 13, 17 are insulated from dust-loaded tool holder 2 by collar 18.

Collar 18 is preferably formed entirely from an elastomer. The elastomer is preferably a polyurethane or a hydrogenated nitrile rubber. This elastomer class has the necessary dynamic strength to continuously withstand the accelerations on anvil 11, in particular if the elastomer is free of polycyclic aromatic hydrocarbons.

Collar 18 preferably has an axial pretension in the working position. The pretension increases the stability of collar 18. Collar 18 applies a force acting in impact direction 9 onto anvil 11 when anvil 11 is in the working position. Elastic hose 21 has an original form. Diaphragm 21 counteracts a deformation along working axis 4 due to a corresponding force. The pretension is set by the axial offset of inner ring 19 with respect to outer ring 20. The pretension is sufficient, for example to push anvil 11 out of the working position into a position which shuts off striking mechanism 8.

A sealing ring 22 abuts impact-delivering end 15 of anvil 11. Sealing ring 22 is situated upstream from collar 18 in impact direction 9. Sealing ring 22 is anchored, for example in power tool housing 6 and slides on the cylindrical surface of anvil 11. Alternatively, sealing ring 22 may be anchored in impact-delivering end 15 and slide on a hollow cylindrical surface of power tool housing 6. Sealing ring 22 is preferably situated in impact direction 9 behind idle stroke damper 17. The chamber between collar 18 and sealing ring 22 is provided with the surrounding space for an air exchange via a cut 23. Cut 23 preferably opens the chamber in the radial direction.

Electric motor 24 is powered via the power supply. Electric motor 24 may be a universal motor, a mechanically commutating electric motor 24 or an electrically commutating electric motor 24. The user may switch electric motor 24 on and off with the aid of an operating switch 25. Operating switch 25 is situated on or near handle 5 and may be preferably actuated by the hand holding handle 5.

Electric motor 24 moves exciter piston 26 back and forth on working axis 4. Exciter piston 26 is guided on working axis 4, for example in a guiding tube 27. A converting gearing 28 connects electric motor 24 to exciter piston 26. Converting gearing 28 converts the rotational movement of electric motor 24 into a translational movement of exciter piston 26. Examples of converting gearings 28 are based on an eccentric wheel and a connecting rod or a wobble plate and a wobble finger. A stepped-down gearing 29, a friction clutch, etc. may be situated on the drive train between electric motor 24 and converting gearing 28. The periodicity of exciter piston 26 is mechanically synchronized with the rotational speed of electric motor 24 via the drive train.

Pneumatic chamber 31 is closed by exciter piston 26 and striker 10 along working axis 4. The example of guiding tube 27 may close pneumatic chamber 31 in the radial direction. In the illustrated embodiment, exciter piston 26 and striker 10 are movable within guiding tube 27. Exciter piston 26 closes guiding tube 27 in impact direction 9, and exciter piston 26 closes guiding tube 27 against impact direction 9. Exciter piston 26 compresses and decompresses pneumatic chamber 31. Striker 10 is accelerated accordingly in impact direction 9 and against impact direction 9 by the pressure difference between pneumatic chamber 31 and the surroundings. In alternative specific embodiments, the exciter piston may have a cup-shaped design, and the striker may be guided in the exciter piston, or the striker is cup-shaped and encompasses the exciter piston.

Figure 3:
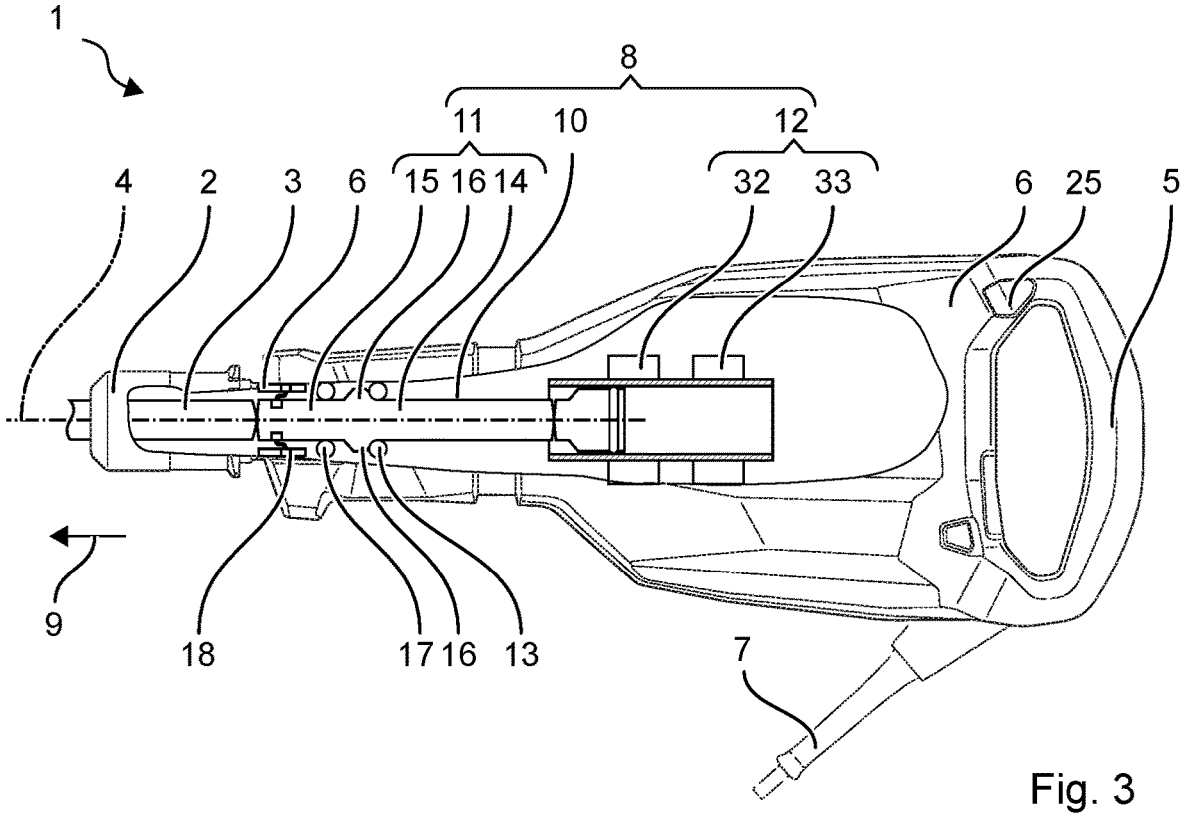
FIG. 3 shows an electric hammer.

Drive 12 may include two solenoid coils 32, 33, which move striker 10 along working axis 4 according to the reluctance principle (FIG. 3). Solenoid coils 32, 33 may, in addition to pneumatic drive 12 described above, accelerate striker 10.

What is claimed is:

1. A handheld power tool comprising:

a tool holder for receiving and locking a tool on a working axis;

a power tool housing;

a striking mechanism including a striker for applying impacts in an impact direction and an anvil for (a) absorbing the impacts, (b) transmitting the impacts in the impact direction onto the tool accommodated in the tool holder, and (c) abutting a rebound impact damper in a direction opposite the impact direction; and an elastic collar fastened to the power tool housing and to the anvil, the collar applying onto the anvil a force acting in the impact direction when the anvil abuts the rebound impact damper.

2. The handheld power tool as recited in claim 1 wherein the collar includes an inner ring fastened to the anvil, an outer ring fastened to the power tool housing, and an elastic diaphragm connecting the inner ring to the outer ring.

3. The handheld power tool as recited in claim 2 wherein the diaphragm is elastically pretensioned when the anvil abuts the rebound impact damper.

4. The handheld power tool as recited in claim 3 wherein the diaphragm is made from an elastomer which is free of polycyclic aromatic hydrocarbons.

5. The handheld power tool as recited in claim 2 wherein the anvil has an end pointing in the impact direction for transmitting an impact onto a tool, the inner ring being fastened to the end.

6. The handheld power tool as recited in claim 5 wherein the anvil includes a stop ring situated in the impact direction upstream from the end pointing in the impact direction.

7. The handheld power tool as recited in claim 6 wherein the stop ring abuts the rebound impact damper against the impact direction in a working position.

8. The handheld power tool as recited in claim 6 further comprising an idle stroke damper situated in the impact direction downstream from the stop ring, and the inner ring is situated in the impact direction downstream from the idle stroke damper.

9. The handheld power tool as recited in claim 1 wherein the anvil is movably supported in the power tool housing opposite the striker along the working axis.

* * * * *